US006626730B1

(12) United States Patent
Yu

(10) Patent No.: US 6,626,730 B1
(45) Date of Patent: Sep. 30, 2003

(54) FOLDABLE DEVICE SUITED FOR TOYS

(76) Inventor: Jui Hsia Yu, P.O. Box 26-757, Taipei (TW), 106

( * ) Notice: Subject to any disclaimer, the term of this patent is extended or adjusted under 35 U.S.C. 154(b) by 0 days.

(21) Appl. No.: 10/205,716

(22) Filed: Jul. 23, 2002

(51) Int. Cl.[7] ..... A63H 3/36

(52) U.S. Cl. ..... 446/320; 446/314; 446/366; 446/378; 446/487; 446/489

(58) Field of Search ..... 446/320, 311, 446/312, 314, 315, 487, 489, 366, 365, 378, 478

(56) References Cited

U.S. PATENT DOCUMENTS 2,741,870 A * 4/1956 Lang
3,235,259 A * 2/1966 Glass et al.
3,710,506 A * 1/1973 Thornell
3,856,304 A * 12/1974 Matsumoto et al. ..... 273/85 F
4,319,751 A * 3/1982 Kurushima et al. ..... 273/85 E
4,367,875 A * 1/1983 Barlow et al. ..... 273/85 F
5,181,727 A * 1/1993 Fukumura ..... 273/450
5,310,380 A * 5/1994 Levy et al. ..... 446/489

* cited by examiner

*Primary Examiner*—Derris H. Banks
*Assistant Examiner*—Ali Abdelwahed
(74) *Attorney, Agent, or Firm*—Rosenberg, Klein & Lee

(57) ABSTRACT

A foldable device suited for toys comprises a connecting rod and a retractable cylinder both sleeved by a toy shank support, wherein a bottom end of the connecting rod is connected to a transmission device that can force the connecting rod to move downward and upward, characterized in that a first snapping bead box is installed at a bottom end of the retractable cylinder, the first snapping bead box is equipped with a snapping bead and a spring, one end of the connecting rod is inserted into and passes through the first snapping bead box, a backside of the snapping bead leans against the connecting rod and is in contact with the sidewall of the first snapping bead box through a spring, and a recess is provided on the connecting rod above the first snapping bead box.

3 Claims, 6 Drawing Sheets

FOLDABLE DEVICE SUITED FOR TOYS

BACKGROUND OF THE INVENTION

1. Field of the Invention

The present invention relates to a foldable device suited for toys having an improved rigid structure and performance.

2. Description of the Prior Art

Foldable devices are used vastly in 3D-toy industry, especially in human-like toys. These human-like toys are typically made small in size for the sake of manufacturing or transportation reasons. The foldable device installed in these toys can elongate the vertical size of these toys so that these toys look to scale and present a vivid personality. However, the prior art foldable device has a complicated structure and is thus expensive. Further, the prior art foldable device used in a toy is too heavy to carry. Accordingly, there is a strong need to provide an improved foldable device for toys, thereby improving ease of use, simplifying the structure of the foldable device, and decreasing the cost of the device.

SUMMARY OF THE INVENTION

It is a primary object of the present invention to provide an improved foldable device suited for toys so as to solve the above-mentioned problems.

According to the claimed invention, a foldable device suited for toys comprises a connecting rod and a retractable cylinder both sleeved by a toy shank support, wherein a bottom end of the connecting rod is connected to a transmission device that can force the connecting rod to move downward and upward, a first snapping bead box is installed at a bottom end of the retractable cylinder, the first snapping bead box is equipped with a snapping bead and a spring, one end of the connecting rod is inserted into and passes through the first snapping bead box, a backside of the snapping bead leans against the connecting rod and is in contact with the sidewall of the first snapping bead box through a spring, and a recess is provided on the connecting rod above the first snapping bead box.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
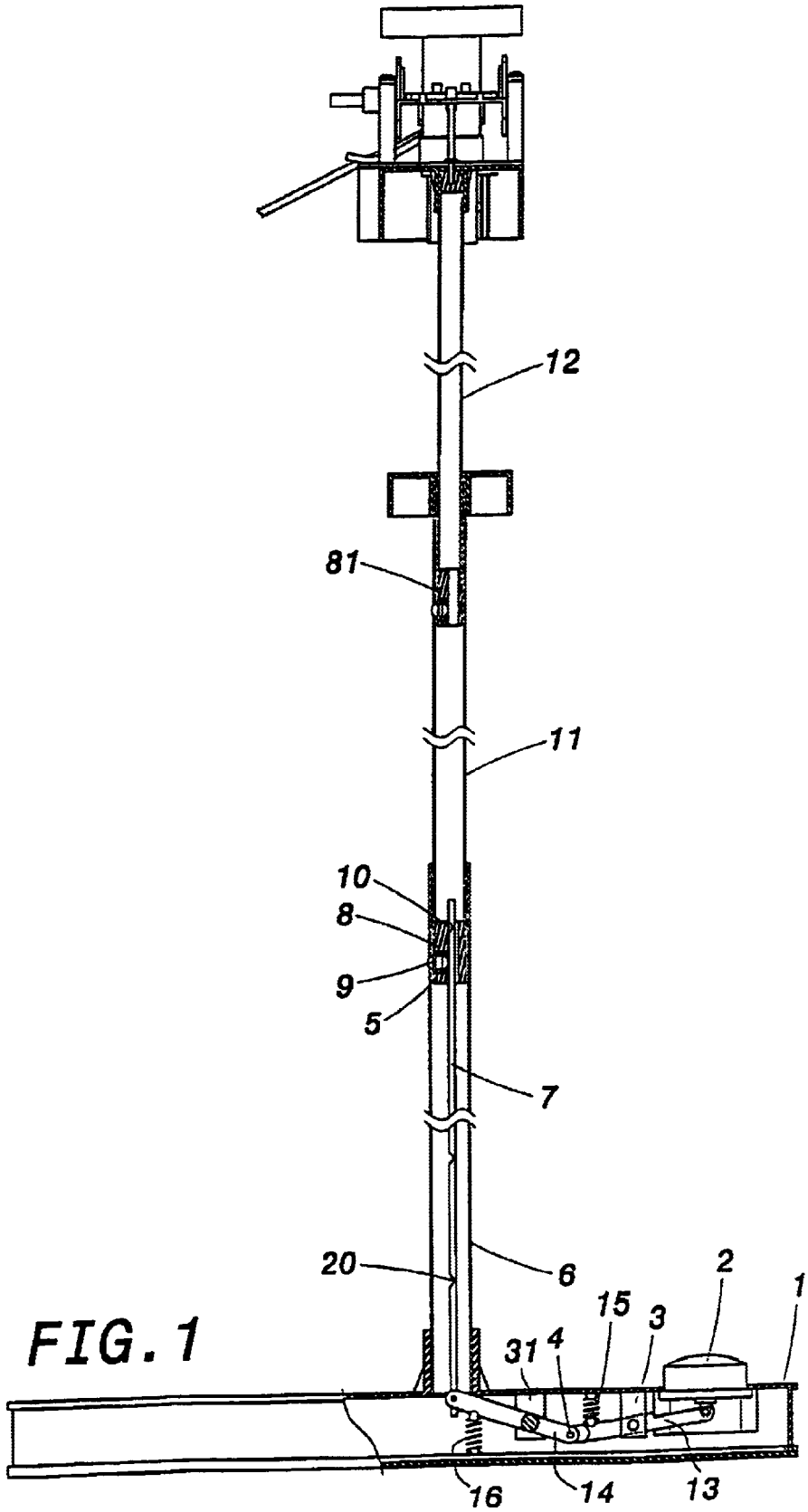
FIG. 1 is a cross-sectional view of a foldable device according to one preferred embodiment of the present invention.
Figure 2:
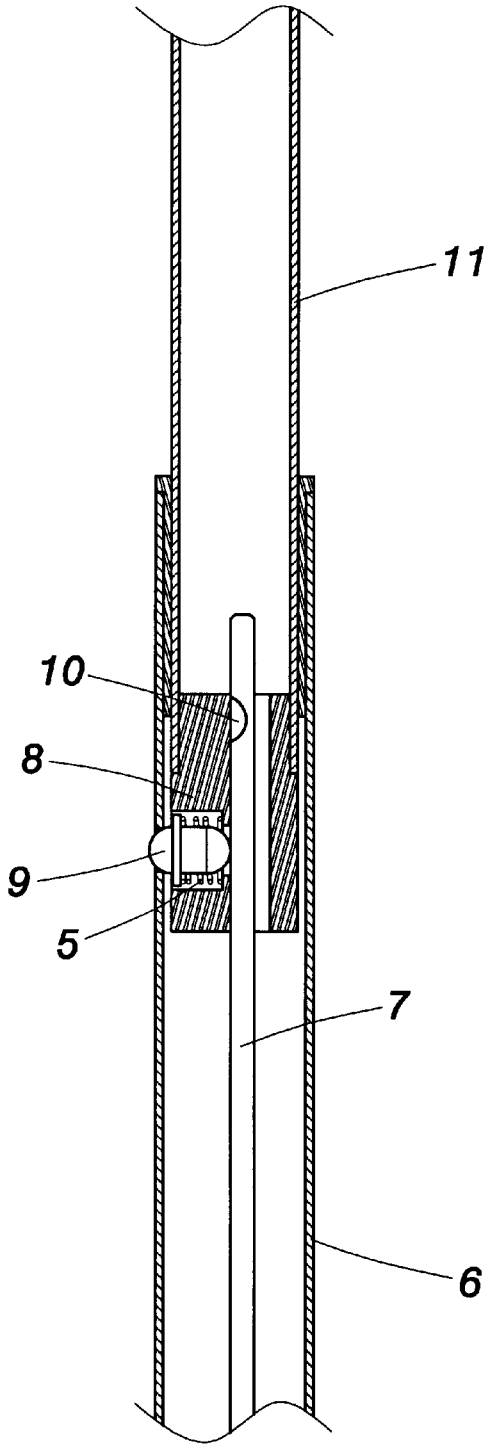
FIG. 2 is an enlarged, cross-sectional view of the foldable device according to one preferred embodiment of the present invention.
Figure 3:
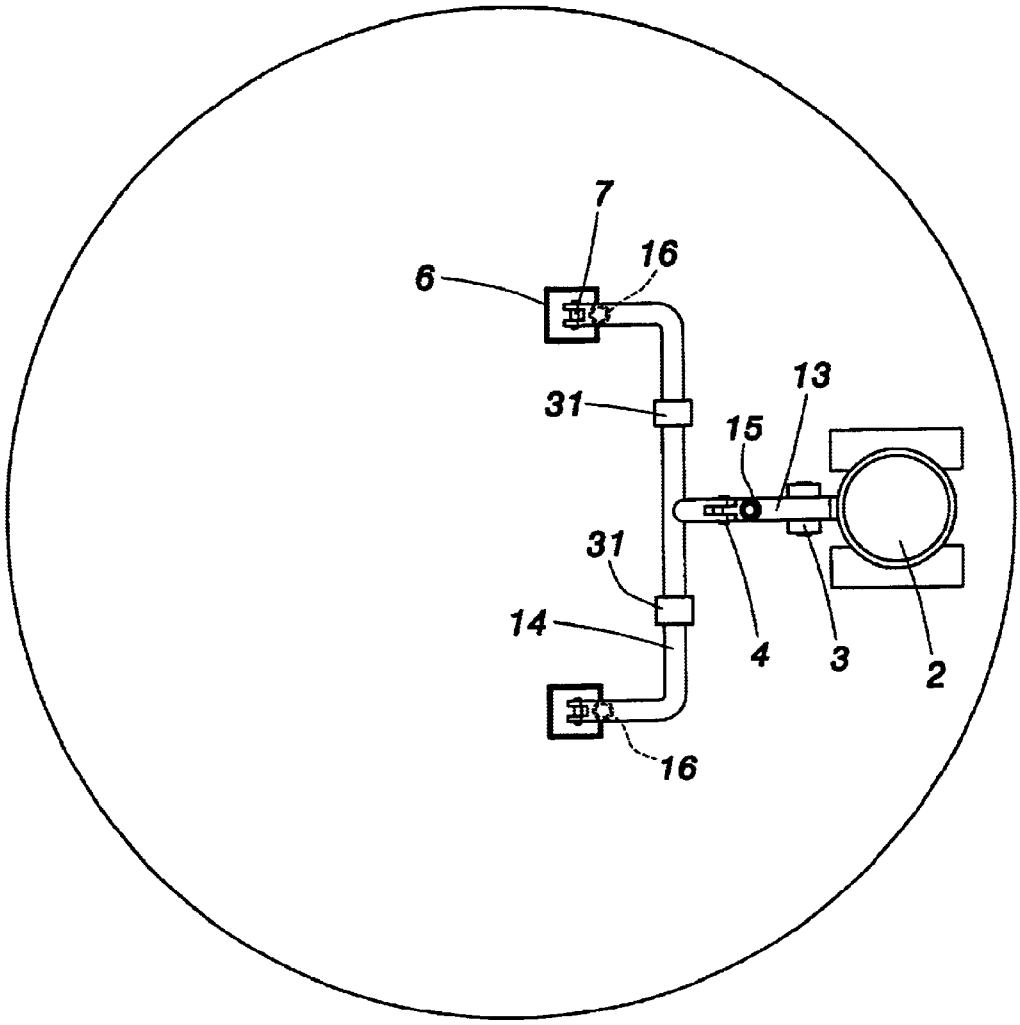
FIG. 3 is a top view showing the inner components of this invention.

Please refer to FIG. 1 through FIG. 3. The present invention is directed to a foldable device suited for toys. The foldable device of this invention comprises a fixed cylindrical shank 6, which is typically a main inner support of a toy. A connecting rod 7 is installed within the cylindrical shank 6. A retractable cylinder 11 is connected to the cylindrical shank 6. A bottom end of the connecting rod 7 is connected to a transmission device that can force the connecting rod 7 to move upward or downward. A flexible first snapping bead box 8 is fixed at the bottom of the retractable cylinder 11. The first snapping bead box 8 comprises a snapping piece such as a snapping bead 9, and a spring 5. As indicated, the backside of the snapping bead 9 leans against the connecting rod 7. Through the spring 5 that provides a backward force, the snapping bead 9 is in contact with the sidewall of the first snapping bead box 8. A recess 10 is provided on the connecting rod 7 at a proper position just above the box 8. More specifically, the location of the recess 10 depends on the displacement of the connecting rod 7. Further, a recess 20 is provided on the connecting rod 7 at a proper lower position. More specifically, the location of the recess 20 at a proper lower position depends on the length of the connecting rod 7.

According to the preferred embodiment of this invention, the transmission device mainly comprises a base 1, a button 2, fulcrum rack structure 3, spring 15, and rotation rod 13. The rotation rod 13 is supported by the fulcrum rack structure 3. One end of the rotation rod 13 is rotatably mounted to the bottom of the button 2. The other end of the rotation rod 13 is connected to the actuating U rod 14 by means of a rotating shaft 4. As best seen in FIG. 1, a spring 15 is mounted on the upper interior wall of the base 1 and biasing the rotation rod 13. As best seen in FIG. 3, the actuating U rod 14 is held by fulcrum rack structures 31. Springs 16, which are mounted on lower interior surface of the base 1, bias one end of the actuating U rod 14. The actuating U rod 14 is connected to the connecting rod 7. In addition, a sliding rod 12 is sleeved in the top portion of the retractable cylinder 11. At the bottom of the sliding rod 12, a second snapping bead box 81 is installed.

Figure 4:
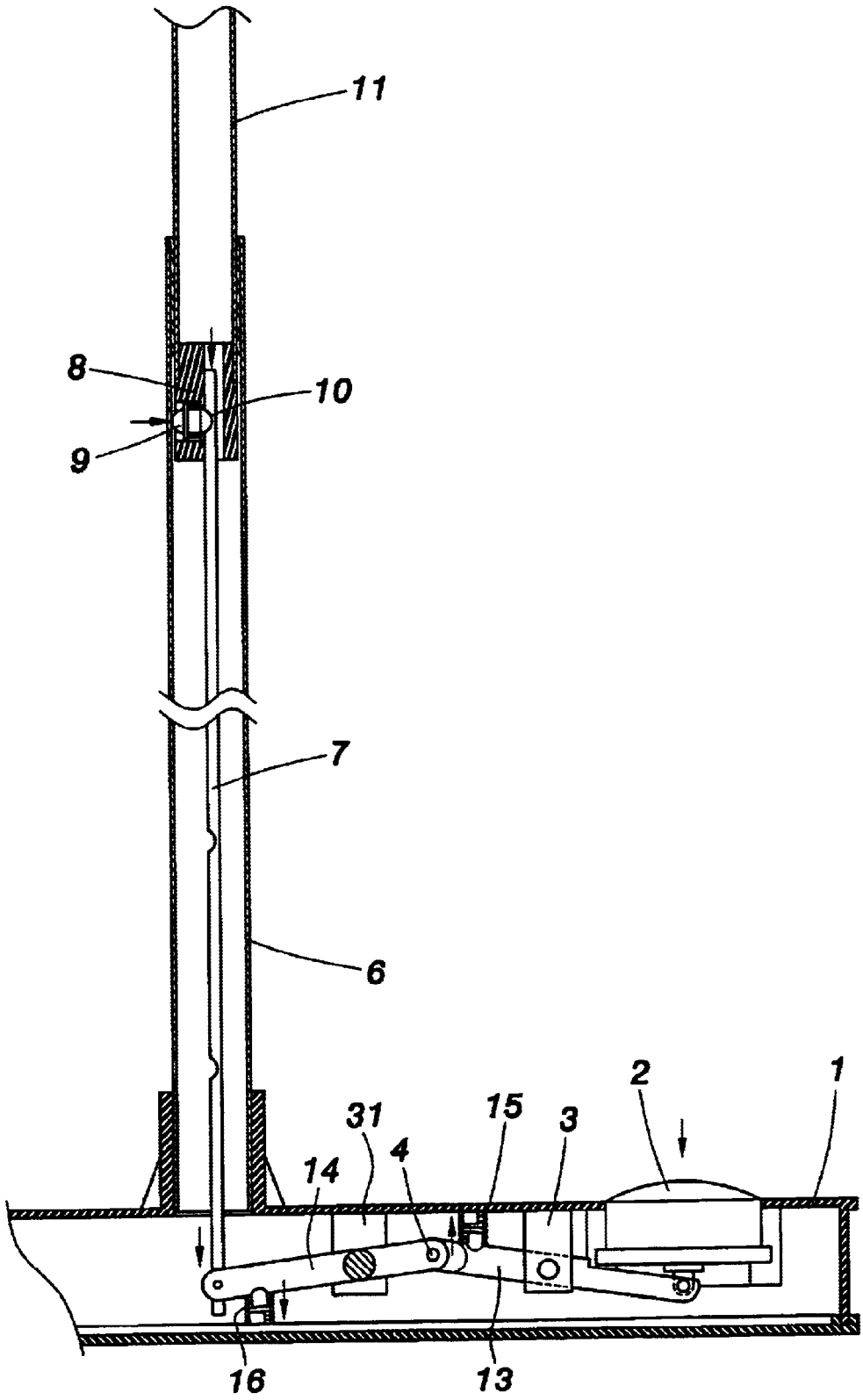
FIG. 4 is a schematic diagram showing the use of this invention
Figure 5:
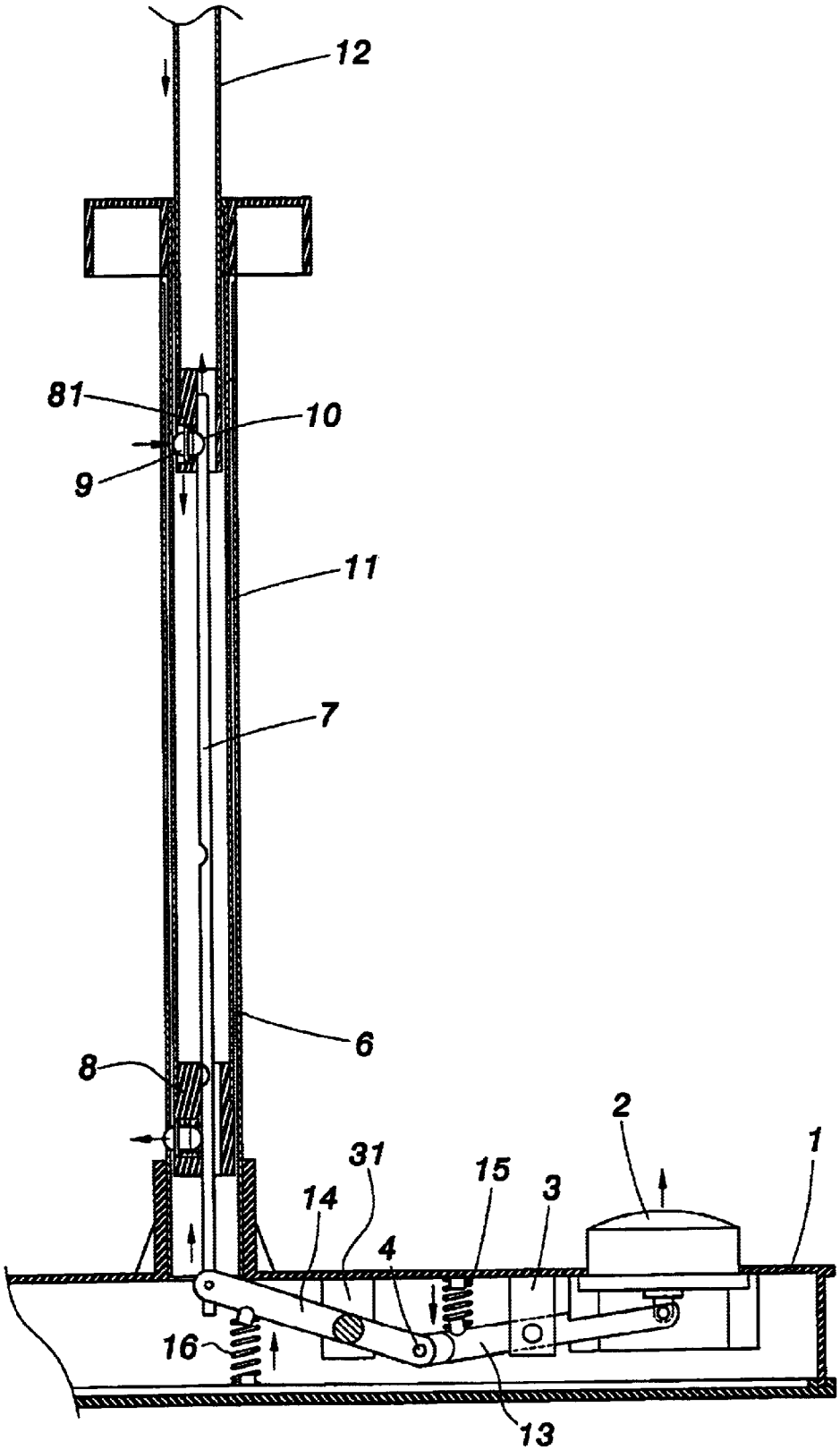
FIG. 5 is a schematic diagram showing the use of this invention.
Figure 6:
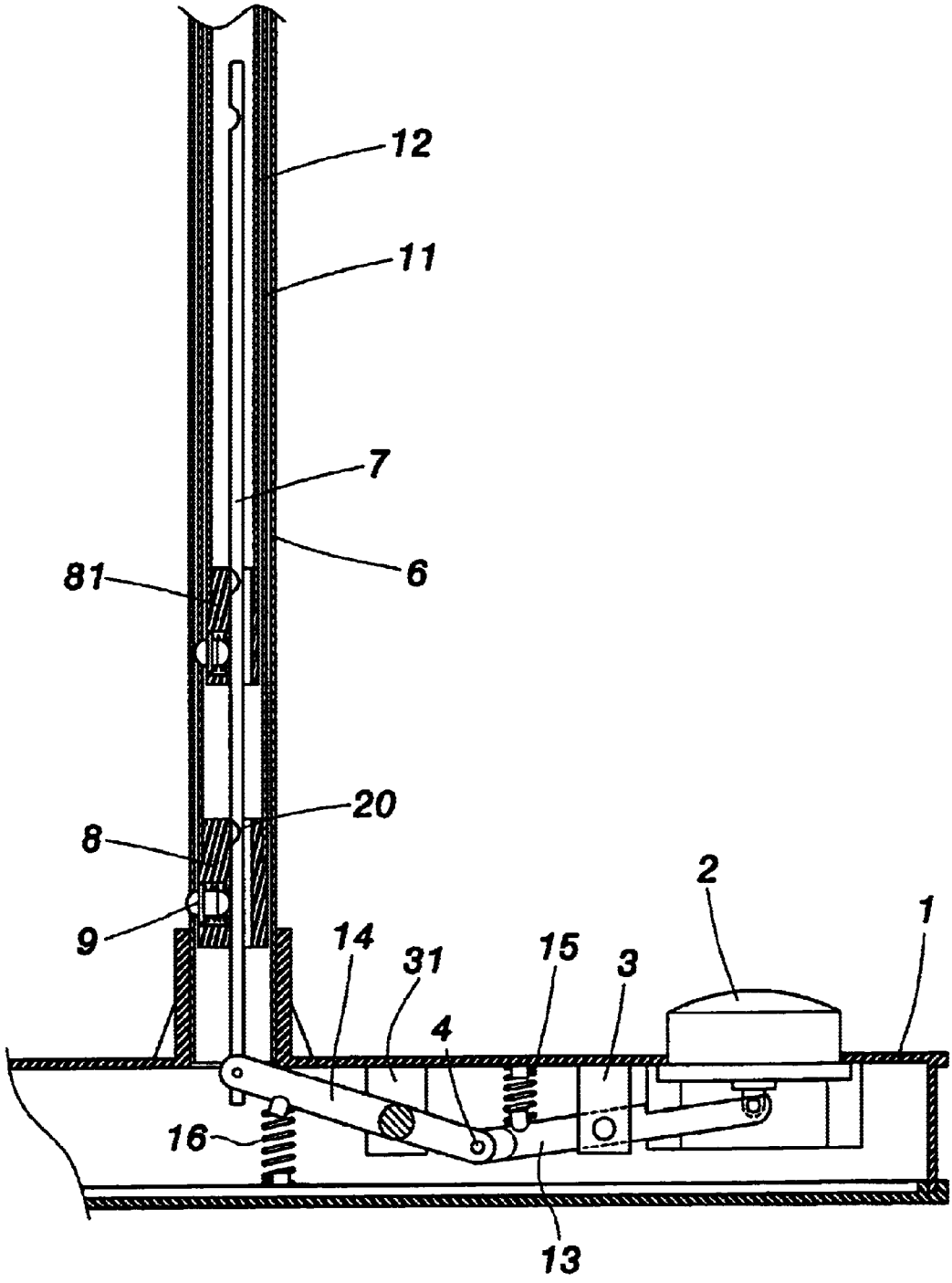
FIG. 6 is a schematic diagram showing the use of this invention.

When implementing a folding action, the button 2 is depressed, as shown in FIG. 4. The button 2 will press the rotation rod 13 and through the transmission device the connecting rod 7 is pulled downward. The snapping bead 9 of the box 8 retracts into the recess 10 on the connecting rod 7. Upon the snapping bead 9 disengaging with the fixed shank 6, the retractable cylinder 11 falls freely in the fixed shank 6, as shown in FIG. 5. When releasing the button 2, the snapping bead 9 of the box 8 will be automatically stuck in the recess 10 of the connecting rod 7. Likewise, as shown in FIG. 6, the sliding rod 12 installed at the top portion of the retractable cylinder 11 will automatically slide downward due to inertia interaction. The snapping bead 9 disengages with the retractable cylinder 11 to achieve the goal of folding the device. When implementing a raising action, the button 2 is depressed, the retractable cylinder 11 can move upward smoothly in the shank 6 since there is a recess 20 disposed at the lower portion of the connecting rod 7.

In contrast to the prior art device, the present invention provides an improved foldable device having a simplified structure and precise positioning characteristic. The improved foldable device is suited for toys, light in weight, and is user-friendly. Further, the present invention has a wide vertical stretching range and is inexpensive in cost.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A foldable device for toys, comprising:

a connecting rod sleeved by a fixed shank, a bottom end of the connecting rod being connected to a transmission device for displacing the connecting rod downward and upward, a retractable cylinder sleeved by the fixed shank; and, a first snapping bead box installed at a bottom end of the retractable cylinder, the first snapping bead box including a snapping bead and a spring, one end of the connecting rod being inserted into and passed through the first snapping bead box, a backside of the snapping bead leaning against the connecting rod and being in contact with a sidewall of the first snapping bead box through a bias force of the spring, and a recess being provided on the connecting rod above the first snapping bead box.

2. The foldable device of claim 1 wherein the connecting rod has a second recess at a lower portion thereof.

3. The foldable device of claim 1 wherein a sliding rod is provided at a top portion of the retractable cylinder and a second snapping bead box is installed at a bottom end of the sliding rod.

* * * * *